United States Patent [19]

Hickey

[11] Patent Number: 4,631,841

[45] Date of Patent: Dec. 30, 1986

[54] SHOE INSERT DEVICE

[76] Inventor: John L. Hickey, 2605 Roca Verde, Spring Valley, Calif. 92011

[21] Appl. No.: 711,829

[22] Filed: Mar. 14, 1985

[51] Int. Cl.[4] ..... A43B 7/22

[52] U.S. Cl. ..... 36/91; 36/71; 36/43; 128/610; 128/586

[58] Field of Search ..... 36/88, 91, 95, 43, 44, 36/71; 128/581, 586, 596; 128/585, 595, 610, 607, 614

[56] References Cited

U.S. PATENT DOCUMENTS

| | | | |
|---|---|---|---|
| 826,330 | 7/1906 | Haag | 36/37 |
| 897,920 | 9/1908 | McIntyre | 36/37 |
| 1,084,264 | 1/1914 | French | 36/43 |
| 1,808,461 | 6/1931 | Gregarek | 36/43 X |
| 1,986,441 | 10/1934 | Feldman | 36/71 |
| 2,221,202 | 11/1940 | Ratcliff | 129/596 |
| 2,330,398 | 9/1943 | Vass | 36/91 X |
| 2,415,580 | 2/1947 | Davis | 36/43 X |
| 2,436,164 | 2/1948 | Diamond et al. | 128/595 |
| 2,482,333 | 9/1949 | Everston | 36/43 |
| 2,567,028 | 9/1951 | Rapisarda | 128/614 |
| 2,628,440 | 2/1953 | Leydecker | 128/621 |
| 2,633,129 | 3/1953 | Crawford | 128/581 X |
| 2,862,313 | 12/1958 | Jones | 36/71 |
| 2,865,097 | 12/1958 | Vollrath, Jr. et al. | 36/43 |
| 3,265,071 | 8/1966 | Kirchner et al. | 128/586 |
| 3,316,663 | 5/1967 | Neu | 36/71 |
| 4,317,293 | 3/1982 | Single et al. | 36/43 |
| 4,360,027 | 11/1982 | Friedlander et al. | 128/581 |
| 4,408,402 | 10/1983 | Looney | 36/43 |
| 4,423,735 | 1/1984 | Comparetto | 36/28 X |

FOREIGN PATENT DOCUMENTS

| | | | |
|---|---|---|---|
| 1209020 | 9/1959 | France | 128/610 |
| 585532 | 3/1977 | Switzerland | 36/91 |
| 217833 | 6/1924 | United Kingdom | 36/43 |

*Primary Examiner*—Werner H. Schroeder
*Assistant Examiner*—T. Graveline
*Attorney, Agent, or Firm*—Brown, Martin, Haller & Meador

[57] ABSTRACT

A shoe insert device comprises a pad of cushioning material having a forward portion for cushioning the forefoot of a user and a rearward arched portion which is thickened and shaped to conform substantially to the arch of a user's foot. The rearward portion terminates short of the heel region of the foot.

8 Claims, 10 Drawing Figures

FIG. 1
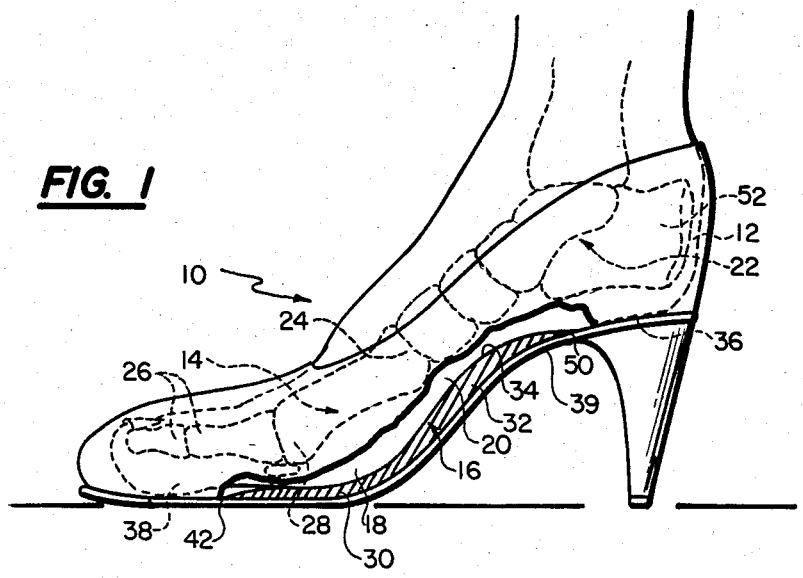
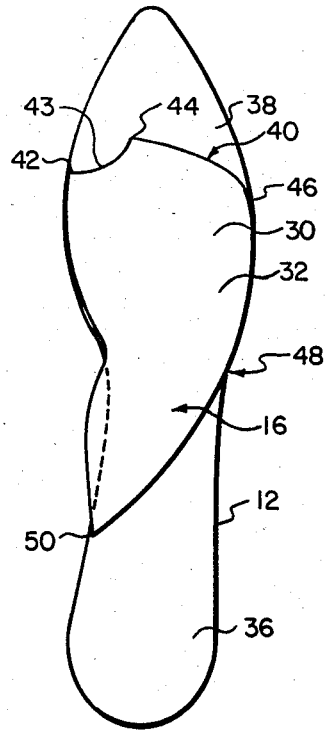
FIG. 2
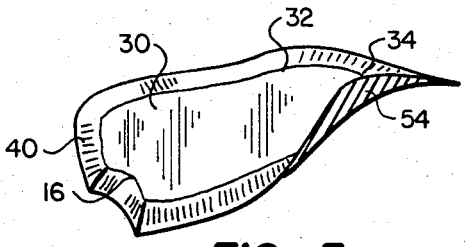
FIG. 3
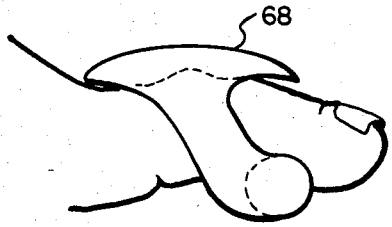
FIG. 10

SHOE INSERT DEVICE

BACKGROUND OF THE INVENTION

The present invention relates to a device for insertion in the sole of a shoe to improve foot comfort and support of a person using the shoe.

Shoes, particularly fashionable shoes of the high-heeled type, are normally not designed with foot comfort and support as the primary object. The human foot consists primarily of the heel area, the arch or metatarsal bone area, and the toe area, and the main support areas of the foot are the heel area and the ball of the foot, or the forward ends of the metatarsal bones. The normal shoe sole is a relatively rigid surface, and pressure and friction of the support areas of the foot against this surface often causes discomfort and the development of calluses. At the same time, the normal shoe does not give adequate support to the arch of the foot, often giving rise to walking problems and sometimes resulting in collapsed arches. This problems are aggravated in high-heeled women's shoes, where the foot is urged forward into the toe box of the shoe in walking. The increased pressure on the ball or forefoot regions when wearing such shoes for prolonged periods often gives rise to a burning sensation in these areas of the foot, and substantially increases fatigue and discomfort.

Shoe insert pads have been used in the past to alleviate some or all of these problems. The pads are either of the whole foot variety or designed for localized pressure areas of the foot, and are generally of a flexible cushioning material of some sort, e.g., foam.

Full foot pads are shaped to conform to the contour of the shoe and thus will cushion the entire foot area. Pads of this type are described, for example, in U.S. Pat. No. 1,084,264 of French and U.S. Pat. No. 897,920 of McIntyre.

In addition to pads or insoles designed simply to cushion the foot for the comfort of the shoe wearer, some shoe insert pads are specifically designed to correct or improve walking or posture of the shoe wearer. In U.S. Pat. No. 4,408,402 or Looney, for example, a supportive shoe insert pad is shaped to fit the sole of a shoe but has specific increased support areas in the region of the heel, arch and outer and inner toes of the wearer. In U.S. Pat. No. 4,317,293 of Single et al, an insole pad is cut back behind the big toe area to reduce the rolling of a person's foot towards the outside.

Other shoe insert pads are known which are not shaped to conform to the contour of a shoe, but which are designed to be applied to specific areas of a shoe sole for various purposes. For example, in U.S. Pat. No. 3,316,663 of Neu, a pad which is arched upwardly towards its forward end is designed to fit below the ball of a person's foot to prevent the foot from sliding forward in a shoe. In U.S. Pat. No. 3,265,071 of Kirchmen, a cushioning pad is designed to be fitted below the arch of a foot. in U.S. Pat. No. 2,482,333 of Everston, a heel-less substantially flat pad of multi-layer construction is described, which may be used to add apparent height to the wearer of a shoe. U.S. Pat. No. 2,862,313 of Jones describes insoles having appertures for the insertion of various resilient pads to support the metatarsal support regions of a person's foot. Finally, U.S. Pat. No. 1,976,441 of Feldman describes a cushion foot and arch support which extends from the heel region to a line just before the toe region of a foot.

The usual full foot shoe insert pad tends to creep or slip down into the toe of the shoe and bunch up under the heel and arch, causing discomfort to the wearer of the shoe. This is true of any insert pad which raises the heel within the shoe, since the heel is the region of most movement of a foot in a shoe.

SUMMARY OF THE INVENTION

One of the advantages of the present invention is the provision of a shoe insert device which is less likely to slip forward under the foot of a person wearing the shoe.

According to the present invention, an insert device for a shoe is provided which comprises a pad of cushioning material shaped to conform to the contour of at least part of the shoe and terminating short of the heel area of the shoe. The pad has a forward flatter portion for supporting the forefoot of the user and a rearward arched portion which is thickened into a curved area shaped generally to conform to the arch of the user's foot in the shoe.

Since the pad terminates short of the heel area of the shoe, where the most foot movement occurs, the tendency for the pad to slip forwards will be reduced.

In one embodiment of the invention the forward portion of the pad is shaped to fit the toe area of a shoe. Foot movement in the toe area is minimal and the pad will therefore stay in place. In another embodiment of the invention, the forward portion of the pad terminates short of the toe area of the digits within the toe box of the shoe. This is particularly suitable for high-heeled shoes, to allow more room for the toes which will be pushed forward in the shoe. In this embodiment, the forward edge of the pad is curved generally to follow the curve of the toes, and lies within the sulcus of the toes of the digits in the foot. The forward edge preferably includes a cut-out area in the region of the big-toe, which will help to control axial rotation of the foot in the shoe, and reduce or relieve shear force to the metatarsal head region of the forefoot.

The shoe insert pad of this invention thus has the advantage of improved foot comfort, particularly for wearers of high or substantially raised heel shoes, since the forefoot area is cushioned while at the same time arch support is provided in the mid-portion of the shoe. The forefoot cushioning will help to reduce or relieve the burning sensation often associated with prolonged wear of raised heel shoes, while the arched area will afford longitudinal arch stability without raising the heel within the shoe.

The pad is preferably formed of a moldable foam material which conforms to the osseous structure of the forefoot on heat and pressure applied by the foot of a shoe wearer using the pad. A suitable adhesive area or strip is applied to the back of the pad for securing it to the sole of a shoe.

BRIEF DESCRIPTION OF THE DRAWINGS

The above and other advantages of the present invention will be more apparent from the following description together with the drawings, in which like reference numerals refer to like parts, and in which:

FIG. 1 is a side view showing a foot in a high-heeled shoe in which a pad according to the first embodiment of the invention has been inserted, with the bone structure of the foot shown to illustrate the positioning of the pad relative to various bone regions of the foot;

FIG. 2 is a top plan view of the pad shown in FIG. 1 placed on the sole of a shoe;

FIG. 3 is a perspective view of the pad;

FIGS. 7 to 10 are perspective views of various comfort pads which may be attached to the sole of a shoe in addition to the insert pad of FIGS. 1 to 3 or FIGS. 4 to 6.

DESCRIPTION OF THE PREFERRED EMBODIMENT

Figure 4:
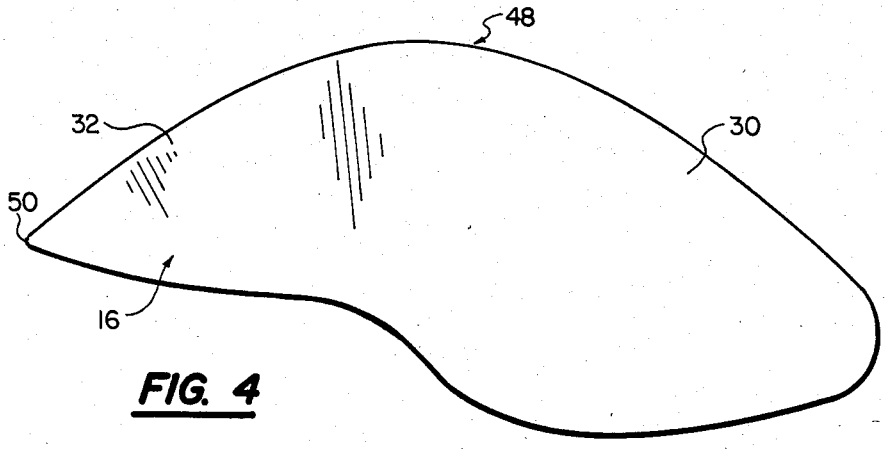
FIG. 4 is a top plan view showing a second embodiment of the invention.

FIG. 1 shows a side view of a human foot 10 in a high-heeled shoe 12 and illustrates the bone structure 14 of the foot in phantom view. A shoe insert pad 16 according to a first embodiment of the present invention is shown placed in the shoe 12 to support and cushion the forefoot 18 and arch area 20 of the foot 1.

The bone structure of the foot basically comprises the heel bones 22 (also known as the tarsus, including the talus and calcaneous), the arch area 20 of the metatarsal bones 24, and the toe bones or phalanges 26. The basic support areas on which pressure is applied when in a standing position as shown in FIG. 1 are the heel area and the forefoot area in the region of the ball of the foot, which corresponds to the forward ends 28 of the metatarsals.

FIGS. 1 to 3 illustrate a first embodiment of a shoe insert pad 16 according to the invention which is designed to support and cushion the forefoot 18 and arch area 20 of the foot. The pad 16 is suitably of a moldable foam material, preferably a closed cell poromeric foam, which will conform itself with wear to the osseous structure of the overlying foot areas. It may however be of any suitable deformable padding material.

The pad comprises a generally flattened forward portion 30 for underlying the forefoot 18, and a rearward arched portion 32 which is thickened and curved on its upper surface 34 to conform to the arch 20 of a person's foot. The pad terminates short of the heel area 36 of the foot 10 and shoe 12.

In this embodiment of the invention, which is particularly suitable for use in high-heeled shoes such as the one shown in FIG. 1, the forward portion 30 of the pad terminates short of the toe area 38 of the foot and shoe. This allows more space for the toes in the toe box of the shoe, and thus allows them freedom of movement during walking.

A suitable pressure sensitive adhesive strip or other securing device (not shown) may be applied to the undersurface of the pad for securing it to the sole of a shoe, but this is not essential.

As can be seen in FIG. 3, the pad is preferably premolded to fit the contour of a high-heeled shoe, with the rearward arched portion 32 being raised relative to the forward portion to follow the arch 39 of the shoe. Although particularly intended for high heeled shoes, the pad may be molded to fit shoes of varying heights and styles. The pad may alternatively be formed flat on its undersurface and bent to fit the shoe when used.

The outline and dimensions of the pad are specifically designed relative to the bone structure of a foot in order to give support and cushioning to the correct regions. This design will be described relative to FIG. 2 which shows a left shoe and pad, but it will be understood that opposite hand pads will be designed in a similar manner to fit right feet and shoes.

FIG. 2 shows the outline of the pad 16 as it relates to the outline of a shoe 12. Starting with the forward edge 40 of the pad, the innermost corner 42 of this edge is arranged to lie at the height of the sulcus, or groove, of the big toe, just distal to the tibial sesamoid. The forward edge 40 curves inwardly and forwardly relative to the foot from this corner to form an indent 43 up to a second point 44 which is below the second toe, underlying the mid-shaft region of the proximal phalanx of this toe. From this point the forward edge 40 curves rearwardly in a generally parabolic curve which corresponds to the curve formed by the ends of the digits and lies within the sulcus, or groove, of the toes. The outer corner 46 of the forward edge of the pad will lie at the outer edge of the shoe.

From the outer corner 46 the pad follows the contour of the shoe (and outer edge of the foot) rearwardly until it reaches a region 48 corresponding to the mid-shaft region of the outer, or fifth, metatarsal bone. At this point, the outer edge of the pad curves rearwardly and inwardly towards the inner edge of the shoe up to the rearmost point 50 of the pad, which lies just below the anterior-medial portion of the calcaneous of heel bone 52 (see FIG. 1). The inner edge of the pad then substantially follows the contour of the shoe back, to the inner corner 42.

As shown in FIGS. 1 and 3, the rearward portion 32 of the pad is thickened and curves upwardly on its upper face to conform to the arch of a foot. Preferably, the thickest portion of the arched area of the pad is of the order of ¼ inch or 0.63 cms. thick.

The pad shown in FIGS. 1 to 3 is particularly suitable for high-heeled shoes of the closed, court type or open-toe sandal type, although it may be used with flat or flatter shoes. It combines forefoot support and cushioning with arch support, and will not tend to slip forward in the shoe since it does not raise the heel of a foot in the shoe, and also since it does not extend into the toe region of the shoe. The toes will therefore also help to hold the pad in place.

The forward edge of the pad is designed to give freedom of movement of the toes while reducing axial rotation or pronation of the metatarsal head region of the forefoot. The cut back area or indent 43 in the forward edge of the pad below the big toe will help to restrain or reduce rolling of this toe, and can help to reduce shear forces in the metatarsal head region which result from rolling of the foot towards the outside during walking.

Figure 5:
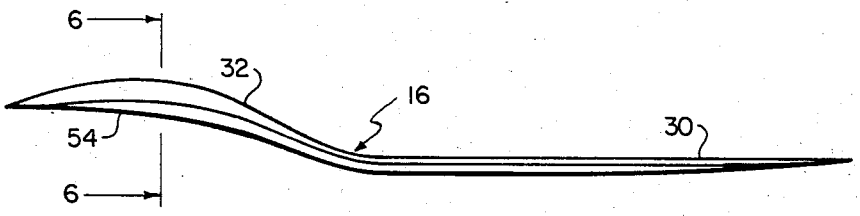
FIG. 5 is a side view of the pad shown in FIG. 4.

FIGS. 4 and 5 show a modified embodiment of the invention in which like reference numerals refer to like parts. In FIGS. 4 and 5 the forward portion 30 of the pad is extended to fit the toe area of a shoe. The rear portion 32 is shaped substantially the same as the rear portion of the embodiment shown in FIGS. 1 to 3 and terminates at an equivalent point 50 short of the heel area.

Figure 6:
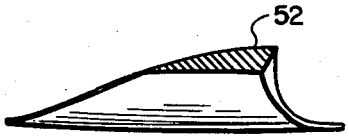
FIG. 6 is a section on the lines 6—6 of FIG. 5.

As can be seen in FIG. 5, the pad is pre molded so that the rear portion 32 is raised relative to the forward portion 30 to fit the arch of a heeled shoe. Various pads can be made in this way to fit various heights of heeled shoes. FIGS. 6 shows a cross section through the pad 16, illustrating the closed cell poromeric foam material 52 from which it is made in the preferred embodiment. However, alternative cushioning materials may be used for the pad.

In both of the embodiments described above, the edges of the forefoot portion of the pad are skived or beveled from a maximum thickness, which in the preferred embodiment is of the order of about 3.5 mm, down to a point even with the sole of a shoe. This reduces the effect of a ridge forming at the outer edge of an insert pad after prolonged wear. The outer edge of the rear portion 32 is similarly skived or beveled, while the inner edge 54 at the arch area of the pad is inclined inwardly towards the sole of the shoe, as seen in FIGS. 3 and 5.

In both of the embodiments described above pad movement in the shoe during wear will be substantially reduced or minimal. The forefoot region of a person's foot will be cushioned by the pad to reduce the burning sensation associated with prolonged wear of heeled shoes, and the arched rear portion of the pad will support and cushion the arch of a person's foot to reduce the risk of collapsed arches and also to make the shoe more comfortable.

Figure 7:
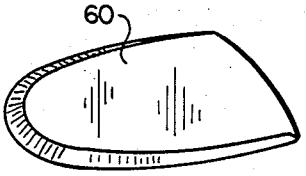
Figure 9:
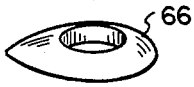
Figure 8:
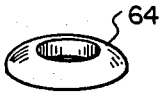

FIGS. 7 to 10 illustrate various localized comfort pads which may be used if desired in conjunction with either of the pads described above. FIG. 7 illustrates a heel pad 60 which may be adhesively secured to the heel of a shoe. FIGS. 8 and 9 illustrate comfort pads 64 and 66 for cornus, bunions, and like foot ailments. These pads have adhesive backings for attachment to the sole of a shoe or to the shoe insert pad 16. FIG. 10 illustrates a pad 68 designed to encircle one or more toes to alleviate the discomfort of hammertoes. The pads shown in FIGS. 7 to 10 are suitably made from a moldable foam material similar to that used for the basic shoe insert pad 16.

While specific embodiments of the invention have been described above by way of example, it will be understood that modifications may be made to these embodiments without departing from the scope of the invention, which is defined by the appended claims.

What is claimed is:

1. An insert device for a shoe designed to cushion the forefoot of a wearer, the device comprising:

a one-piece pad of cushioning material shaped to conform to the contour of at least part of the shoe and terminating short of the heel area of the shoe;

the pad having a forward generally flattened portion and a rearward arched portion which is thickened and shaped generally to conform to the arch of a wearer's foot in the shoe;

the forward portion of the pad having a front edge which extends the full width of a wearer's toes in the shoe and which is curved generally to follow the curve of the base of a wearer's toes and lies within the sulcus of the toes;

the rear portion of the pad terminating in a generally pointed area short of the heel of the foot and adjacent the inner edge of the shoe, the outer edge of the pad being curved to follow the outer edge of the shoe up to a region corresponding to the midshaft region of the outer metatarsal bone of the foot, and then curving rearwardly and inwardly to meet the rearmost portion of the pad.

2. The insert device of claim 1, wherein the front edge has an inwardly arced cut out in the region of the base of a wearer's big toe in the shoe.

3. The insert device of claim 1, wherein the shoe is a high heeled shoe and the pad is molded to fit the contour of the shoe, and the rear portion is raised relative to the forward portion of the pad.

4. The insert device of claim 1, wherein the rear area is a point lying in a region generally underlying the anterior medial portion of the calcaneus of the foot.

5. The insert device of claim 1, wherein the rearward portion of the pad has a highest point which lies beneath the talonavicular articulation of a wearer's foot in the shoe.

6. The insert device of claim 1, wherein the thickened arched portion of the pad has an inwardly beveled inner edge.

7. The insert device of claim 1, wherein the pad has a peripheral edge which is beveled.

8. The insert device of claim 1, wherein the pad is of closed-cell moldable foam material.

* * * * *